US007442891B2

(12) United States Patent
Chen

(10) Patent No.: US 7,442,891 B2
(45) Date of Patent: Oct. 28, 2008

(54) ELECTRICAL SOCKET WITH LATCHING MECHANISM

(76) Inventor: Chi-Wen Chen, No. 105, Alley 27, Lane 143, Chun-Kung Road, Taipei City (TW)

( * ) Notice: Subject to any disclaimer, the term of this patent is extended or adjusted under 35 U.S.C. 154(b) by 108 days.

(21) Appl. No.: 11/717,470

(22) Filed: Mar. 12, 2007

(65) Prior Publication Data

US 2008/0105525 A1 May 8, 2008

(30) Foreign Application Priority Data

Nov. 8, 2006 (CN) ..... 2006 2 0158271 U

(51) Int. Cl.
*H01H 1/52* (2006.01)

(52) U.S. Cl. ..... 200/318; 200/51.09; 439/188

(58) Field of Classification Search ... 200/51.02–51.12, 200/51 R, 318, 318.2; 439/188, 346, 650, 439/651, 259

See application file for complete search history.

(56) References Cited

U.S. PATENT DOCUMENTS

| | | | | |
|---|---|---|---|---|
| 3,596,019 | A * | 7/1971 | Koester | 200/51.09 |
| 3,755,635 | A * | 8/1973 | McGill | 200/51.09 |
| 4,080,039 | A * | 3/1978 | Ahroni | 439/620.3 |
| 6,229,107 | B1 * | 5/2001 | Flint et al. | 200/51.09 |
| 6,443,772 | B1 * | 9/2002 | Chen | 439/652 |
| 6,802,741 | B1 * | 10/2004 | Shatkin | 439/620.21 |
| 6,825,427 | B2 * | 11/2004 | Jenks | 200/51.12 |
| 7,249,976 | B1 * | 7/2007 | Watson | 439/651 |

* cited by examiner

*Primary Examiner*—Michael A Friedhofer
*Assistant Examiner*—Lisa N Klaus
(74) *Attorney, Agent, or Firm*—Townsend and Townsend and Crew, LLP

(57) ABSTRACT

An electrical socket includes a pair of terminal units and a latching mechanism. Each of the terminal units includes resilient first and second clamping arms. The latching mechanism includes a pair of engaging projections, each of which is provided on the second clamping arm of a respective one of the terminal units, and a pair of releasing units, each of which is operable so as to move the second clamping arm of a respective one of the terminal units away from the first clamping arm of a respective one of the terminal units.

10 Claims, 5 Drawing Sheets

ELECTRICAL SOCKET WITH LATCHING MECHANISM

CROSS-REFERENCE TO RELATED APPLICATION

This application claims priority of Chinese application no. 200620158271.0, filed on Nov. 8, 2006.

BACKGROUND OF THE INVENTION

1. Field of the Invention

This invention relates to an electrical socket, more particularly to an electrical socket that includes a latching mechanism.

2. Description of the Related Art

Electrical sockets into which electrical plugs are plugged are well known in the art. The known electrical socket, however, does not provide a reliable connection with the electrical plug, which makes the electrical plug prone to inadvertent disconnection.

SUMMARY OF THE INVENTION

Therefore, the object of the present invention is to provide an electrical socket that can overcome the aforesaid drawback of the prior art.

According to the present invention, an electrical socket comprises a main dielectric casing, first and second terminal units, and a latching mechanism. The main dielectric casing includes a front wall formed with a pair of terminal holes adapted for extension of first and second prongs of an electrical plug. Each of the first and second terminal units is adapted to be connected to a respective one of the first and second prongs of the electrical plug and extends into the main dielectric casing. The second terminal unit includes resilient first and second clamping arms adapted for insertion of the second prong of the electrical plug therebetween. The latching mechanism includes an engaging projection and a releasing unit. The engaging projection of the latching mechanism is disposed between the first and second clamping arms, is provided on the second clamping arm, and is adapted to engage a prong hole in the second prong of the electrical plug. The releasing unit is mounted movably on the main dielectric casing, and is operable so as to move the second clamping arm away from the first clamping arm against biasing action of the second clamping arm, thereby disengaging the engaging projection from the prong hole in the second prong of the electrical plug.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
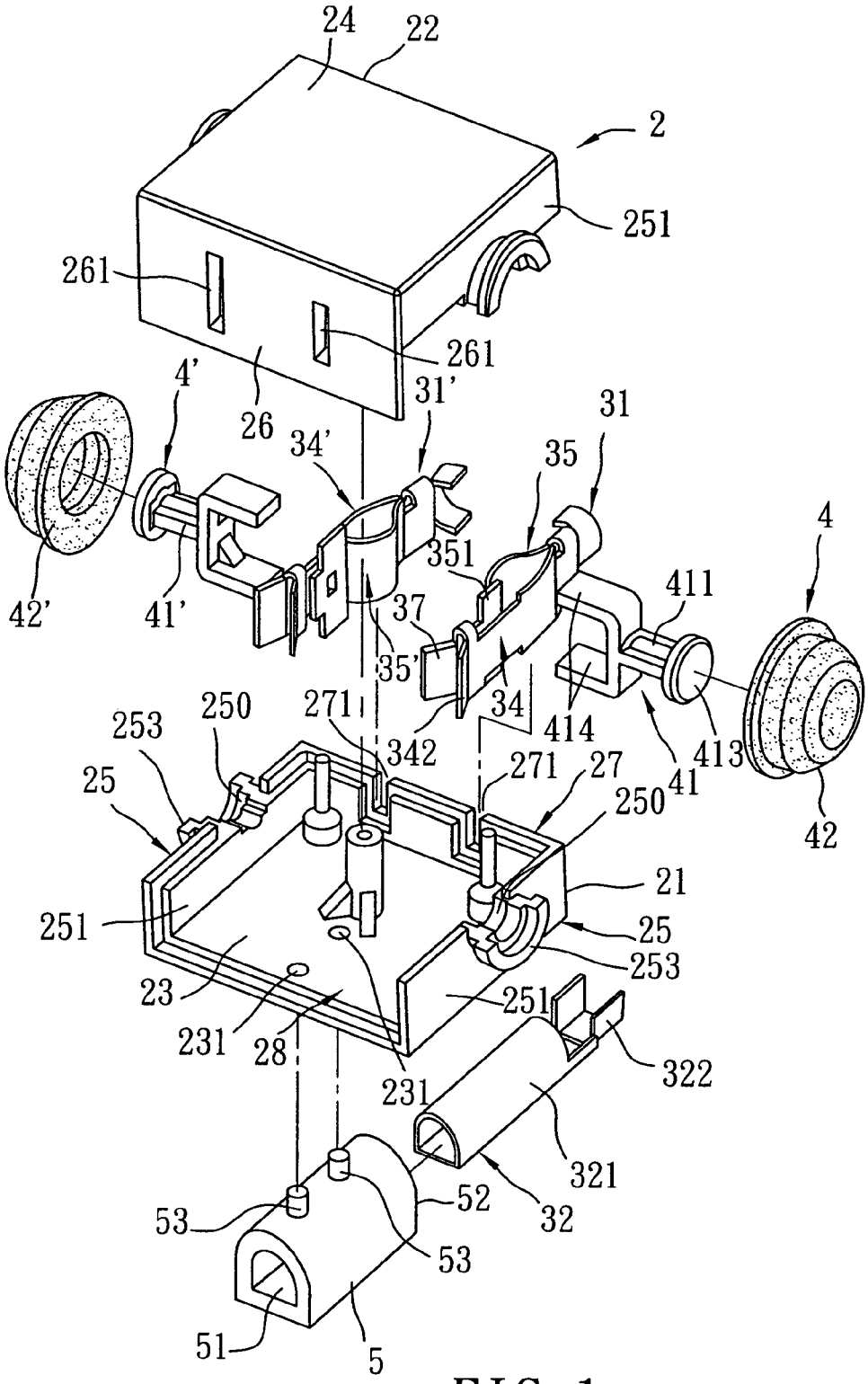
FIG. 1 is an exploded perspective view of the preferred embodiment of an electrical socket according to this invention.
Figure 2:
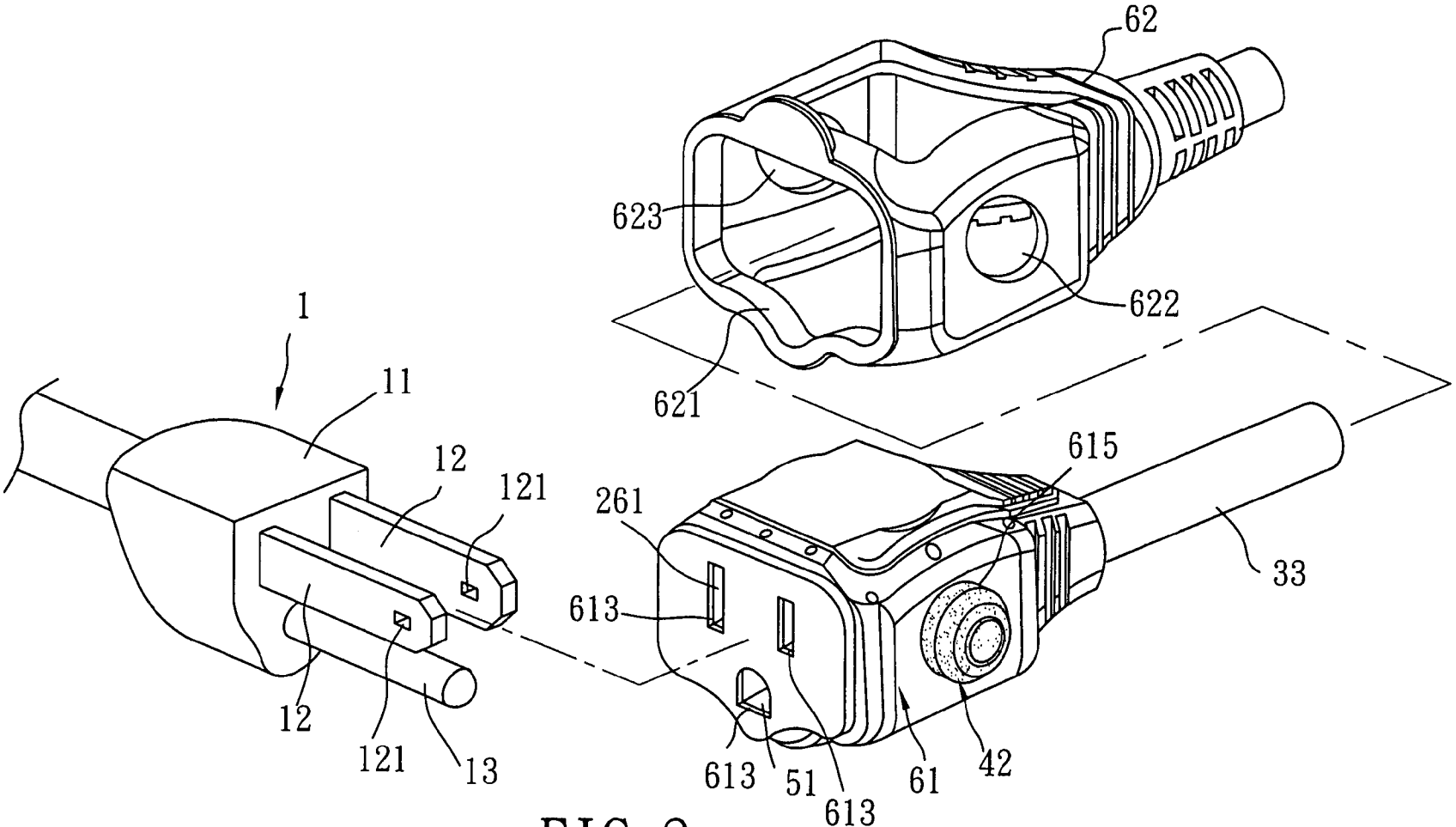
FIG. 2 is a perspective view to illustrate inner and outer jackets of the preferred embodiment.

Referring to FIGS. 1 and 2, an electrical socket includes a main dielectric casing 2, first and second terminal units 31', 31, and a latching mechanism.

The electrical socket of this invention is capable of preventing inadvertent disconnection of an electrical plug 1 plugged thereinto, in a manner that will be described hereinafter.

The electrical plug 1 includes a dielectric body 11, first and second prongs 12, each of which protrudes from the dielectric body 11 and is formed with a prong hole 121 therethrough. Furthermore, the electrical plug 1 includes a third prong 13, which protrudes from the dielectric body 11 and which serves as a grounding prong. Alternatively, the electrical plug 1 may be dispensed with the third prong 13.

The main dielectric casing 2 is generally cube-shaped, defines an interior space 28, and includes opposite top and bottom walls 24, 23, opposite front and rear walls 26, 27, and opposite left and right lateral walls 25. The front wall 26 of the main dielectric casing 2 is formed with left and right terminal holes 261 therethrough, each of which is in spatial communication with the interior space 28 in the main dielectric casing 2. The rear wall 27 of the main dielectric casing 2 is formed with a pair of through-holes 271, each of which is in spatial communication with the interior space 28. Each of the left and right lateral walls 25 of the main dielectric casing 2 is formed with a releasing hole 250 therethrough.

In this embodiment, the main dielectric casing 2 includes complementary first and second casing parts 22, 21 that cooperatively define the interior space 28. The first casing part 22 of the main dielectric casing 2 includes the top wall 24 and the front wall 26 of the main dielectric casing 2. The second casing part 21 of the main dielectric casing 2 includes the bottom wall 23 of the main dielectric casing 2. The rear wall 27 of the main dielectric casing 2 includes complementary wall parts, each of which extends transversely from a respective one of the top and bottom walls 24, 23 of the main dielectric casing 2 and is formed with a pair of grooves. Each of the through-holes 271 in the rear wall 27 of the main dielectric casing 2 is defined by a confronting pair of the grooves in the wall parts of the rear wall 27 of the main dielectric casing 2. Each of the left and right lateral walls 25 of the main dielectric casing 2 includes complementary wall parts 251, each of which extends transversely from a respective one of the top and bottom walls 24, 23 of the main dielectric casing 2 and is formed with a groove. The releasing hole 250 in each of the left and right lateral walls 25 of the main dielectric casing 2 is defined by a confronting pair of the grooves in the wall parts 251 of a respective one of the left and right lateral walls 25 of the main dielectric casing 2.

The electrical socket further includes an auxiliary dielectric casing 5 that is tubular, that has opposite front and rear openings 51, 52, and that is coupled to the main dielectric casing 2. In particular, the bottom wall 23 of the main dielectric casing 2 is formed with a pair of engaging holes 231 therethrough. The auxiliary dielectric casing 5 is provided with a pair of engaging protrusions 53, each of which engages a respective one of the engaging holes 231 in the bottom wall 23 of the main dielectric casing 2, thereby coupling the auxiliary dielectric casing 5 to the main dielectric casing 2.

Figure 3:
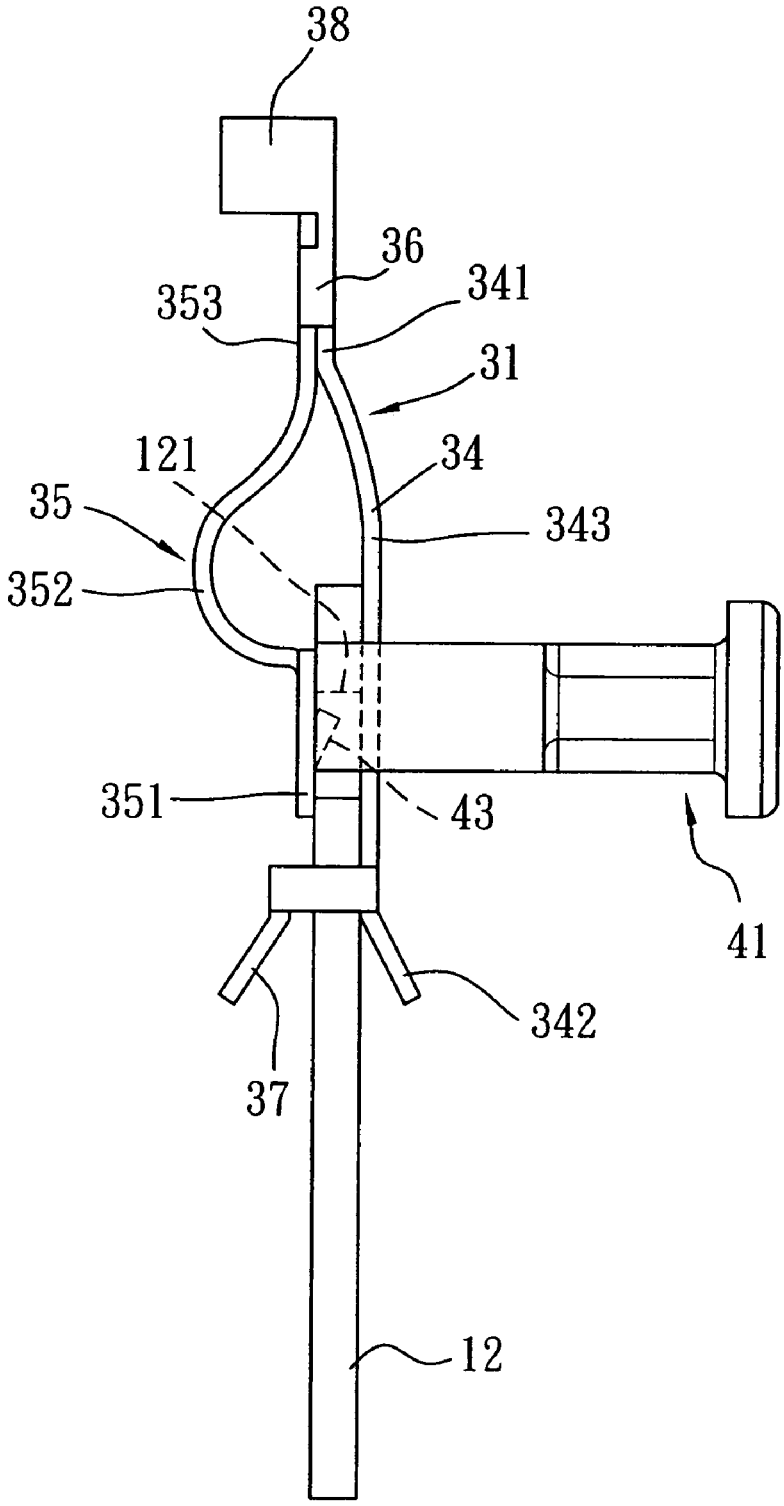
FIG. 3 is a schematic view to illustrate a state when an electrical plug is latched by a latching mechanism of the preferred embodiment.

With further reference to FIG. 3, each of the first and second terminal units 31', 31 extends into the interior space 28 in the main dielectric casing 2 through a respective one of the through-holes 271 in the rear wall 27 of the main dielectric casing 2, and is disposed proximate to a respective one of the left and right lateral walls 25 of the main dielectric casing 2. In this embodiment, the second terminal unit 31 includes resilient first and second clamping arms 34, 35, each of which is disposed in the main dielectric casing 2 such that the first and second clamping arms 34, 35 are respectively proximate to and distal from the right lateral wall 25 of the main dielectric casing 2. Each of the first and second clamping arms 34, 35 has front and rear end portions 342, 351, 341, 353, and a curved middle portion 343, 352 that is disposed between the front and rear end portions 342, 351, 341, 353 of the respective one of the first and second clamping arms 34, 35. The curved middle portions 342, 352 make the first and second clamping arms 34, 35 inherently resilient.

The first terminal unit 31', like the second terminal unit 31, includes resilient first and second clamping arms 34', 35', each of which is disposed in the main dielectric casing 2 such that the first and second clamping arms 34', 35' are respectively proximate to and distal from the left lateral wall 25 of the main dielectric casing 2. The first and second clamping arms 34', 35' are similar in construction to the first and second clamping arms 34, 35.

From the above description, when the electrical plug 1 is plugged into the electrical socket of this invention, each of the first and second prongs 12 of the electrical plug 1 extends into the interior space 28 in the main dielectric casing 2 and is inserted between the first and second clamping arms 34', 34, 35', 35 of a respective one first and second terminal units 31', 31 through a respective one of the left and right terminal holes 261 in the front wall 26 of the main dielectric casing 2.

The electrical socket further includes a cable 33, which includes first, second, and third conductive wires (not shown).

Each of the first and second terminal units 31', 31 further includes an interconnecting arm 36 that interconnects the rear end portions 341, 353 of the first and second clamping arms 34', 34, 35', 35 thereof, and a coupler 38 that extends from a respective one of the interconnecting arms 36 and out of the main dielectric casing 2 through a respective one of the through-holes 271 in the rear wall 27 of the main dielectric casing 2 and that is connected, by crimping, to a respective one of the first and second conductive wires of the cable 33.

Each of the first and second terminal units 31', 31 further includes a guiding arm 37 that is coupled to a free end of the front end portion 342 of the first clamping arm 35', 35 thereof. The guiding arm 37 and the free end of the front end portion 342 of the first clamping arm 34', 34 of a respective one of the first and second terminal units 31', 31 diverge from each other, with a degree of divergence increasing in a direction toward a respective one of the left and right terminal holes 261 in the front wall 26 of the main dielectric casing 2. The construction as such facilitates insertion of each of the first and second prongs 12 of the electrical plug 1 between the first and second clamping arms 34' 34, 35', 35 of a respective one of the first and second terminal units 31', 31 when the electrical plug 1 is plugged into the electrical socket.

The electrical socket further includes a third terminal unit 32 that includes a tubular body 321 that is disposed in the auxiliary dielectric casing 5, and a coupler 322 that extends from the tubular body 321 and out of the auxiliary dielectric casing 5 through the rear opening 52 in the auxiliary dielectric casing 5 and that is connected, by crimping, to the third conductive wire of the cable 33.

From the above description, when the electrical plug 1 is plugged into the electrical socket of this invention, the third prong 13 of the electrical plug 1 is inserted into the tubular body 321 through the front opening 51 of the auxiliary dielectric casing 5.

The latching mechanism latches releasably the first and second prongs 12 of the electrical plug 1 when the electrical plug 1 is plugged into the electrical socket. In particular, the latching mechanism includes a pair of engaging projections 43 and a pair of left and right releasing units 4', 4. Each of the engaging projections 43 of the latching mechanism is disposed between the first and second clamping arms 34', 34, 35', 35 of a respective one of the first and second terminal units 31', 31, and is provided on the front end portion 351 of second clamping arm 35', 35 of the respective one of the first and second terminal units 31', 31. In this embodiment, each of the engaging projections 43 of the latching mechanism extends inclinedly from the front end portion 351 of the second clamping arm 35', 35 of a respective one of the first and second terminal units 31', 31 away from the front wall 26 of the main dielectric casing 2.

From the above description, when the electrical plug 1 is plugged into the electrical socket of this invention, each of the engaging projections 43 of the latching mechanism extends into the prong hole 121 in a respective one of the first and second prongs 12 of the electrical plug 1, as best shown in FIG. 3, thereby preventing inadvertent disconnection of the electrical plug 1.

Each of the first and second terminal units 31', 31 further includes a pair of wings 354 (see FIG. 4), each of which extends from the front end portion 351 of the second clamping arm 35', 35 thereof toward a respective one of the top and bottom walls 24, 23 of the main dielectric casing 2.

Figure 4:
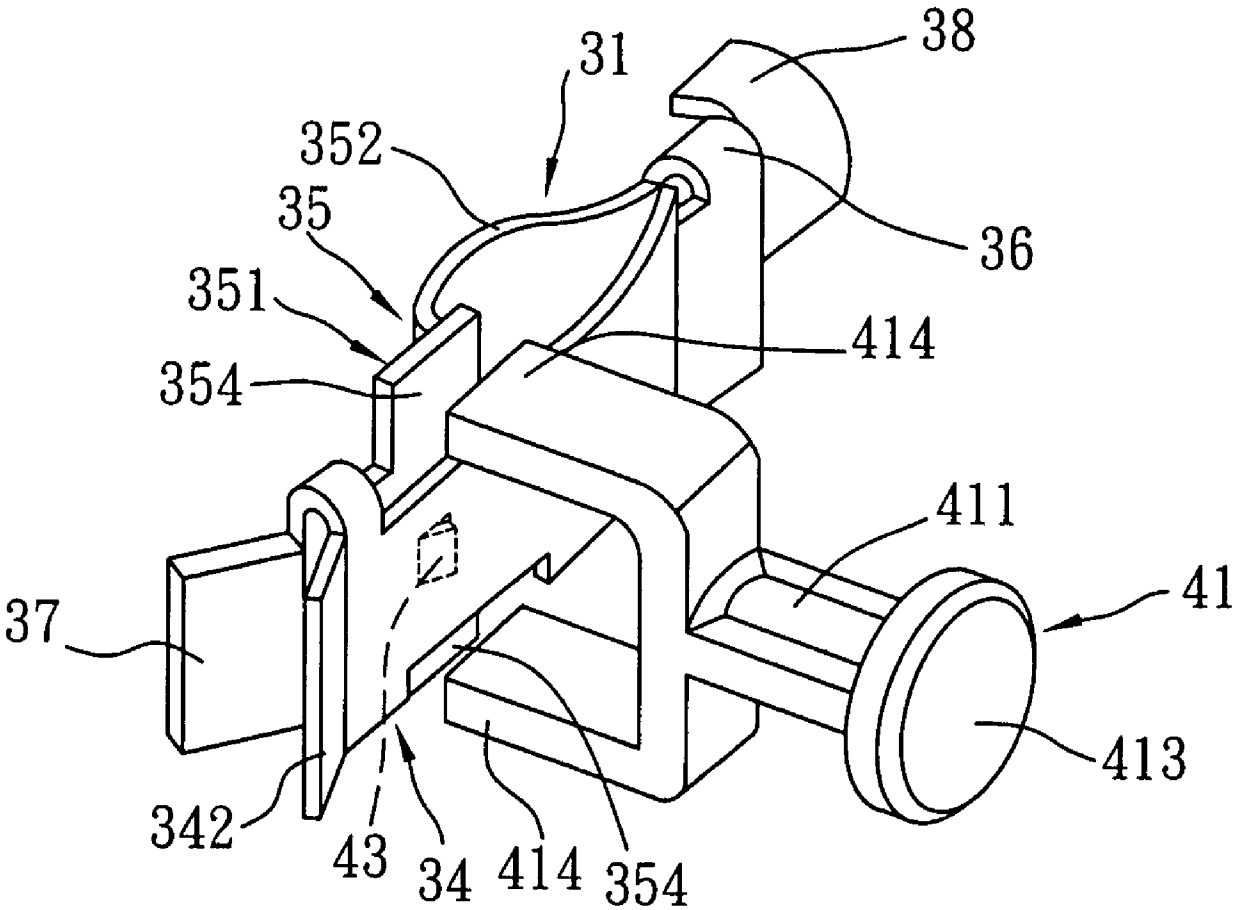
FIG. 4 is a perspective view to illustrate a releasing unit of the preferred embodiment.

With further reference to FIG. 4, the right releasing unit 4 is mounted movably on the right lateral wall 25 of the main dielectric casing 2. In this embodiment, the right releasing unit 4 includes an abutting member 41 that is generally Y-shaped. In particular, the abutting member 41 includes a first arm 411, and second and third arms 414 that diverge from the first arm 411. The first arm 411 of the abutting member 41 extends movably into the interior space 28 in the main dielectric casing 2 through the releasing hole 250 in the right lateral wall 25 of the main dielectric casing 2. Each of the second and third arms 414 of the abutting member 41 is disposed in the interior space 28 in the main dielectric casing 2 and abuts against a respective one of the wings 354 of the second terminal unit 31. The abutting member 41 further includes an enlarged head 413 that is disposed externally of the main dielectric casing 2, that is connected to the first arm 411 thereof, and that has a size larger than that of the releasing hole 250 in the right lateral wall 25 of the main dielectric casing 2.

Figure 5:
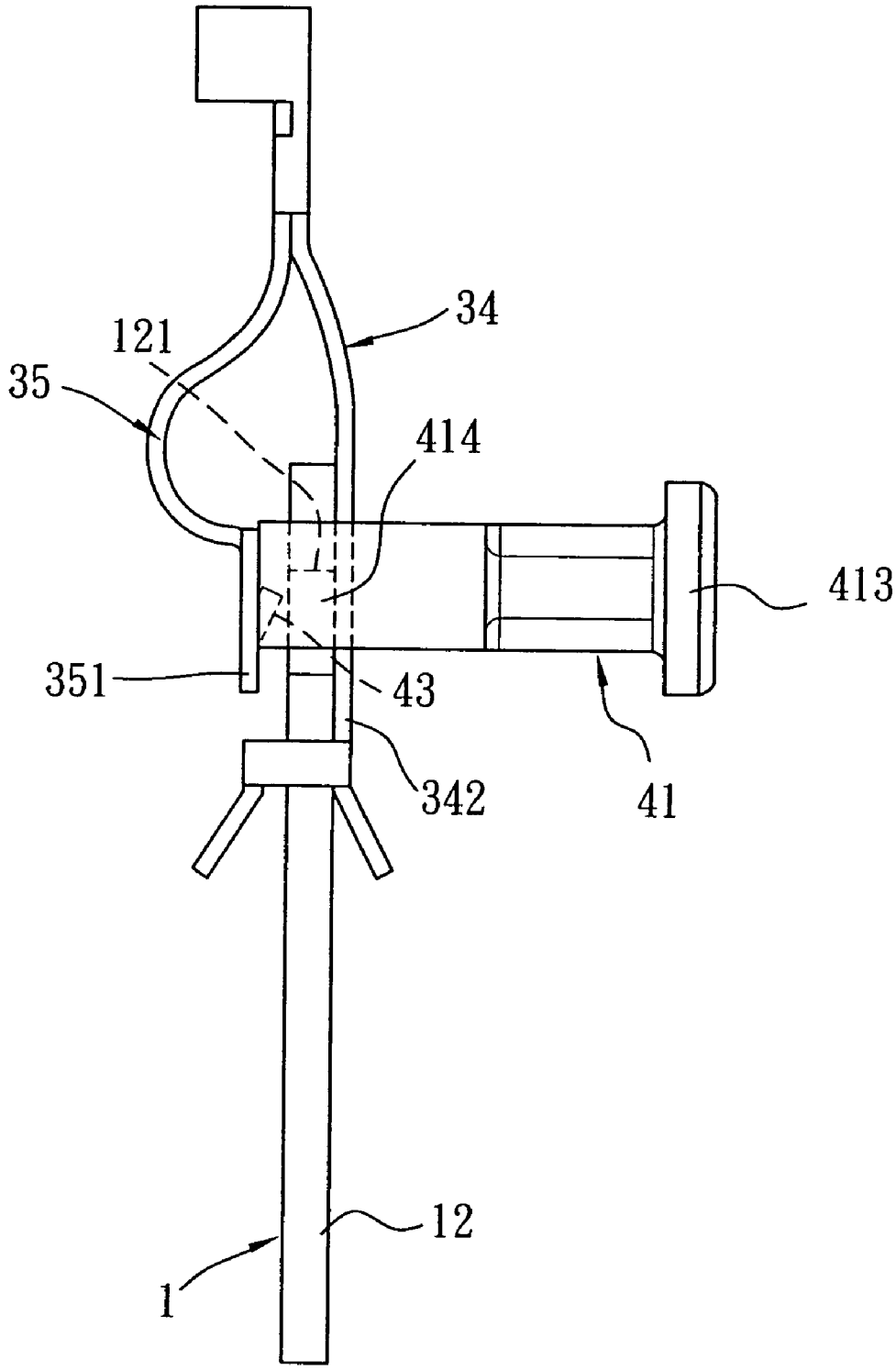
FIG. 5 is a schematic view to illustrate a state when the electrical plug is unlatched by the latching mechanism of the preferred embodiment.

From the above description, when the electrical plug 1 is plugged into the electrical socket of this invention and when the enlarged head 413 of the abutting member 41 of the right releasing unit 4 is pressed, each of the second and third arms 414 of the abutting member 41 pushes a respective one of the wings 354 of the second clamping arm 35 of the second terminal unit 31, which moves the front end portion 351 of the second clamping arm 35 of the second terminal unit 31 away from the front end portion 342 of the first clamping arm 34 of the second terminal unit 31 against the biasing action of the second clamping arm 35 of the second terminal unit 31, thereby disengaging the engaging projection 43 from the prong hole 121 in the second prong 12 of the electrical plug 1, as best shown in FIG. 5.

The left releasing unit 4' is mounted movably on the left lateral wall 25 of the main dielectric casing 2, and includes an abutting member 41'. Since the construction and operation of the abutting member 41' of the left releasing unit 4' are similar to those described hereinabove in connection with the abutting member 41 of the right releasing unit 4, a detailed description of the same will be dispensed with herein for the sake of brevity.

From the above description, when the electrical plug 1 is plugged into the electrical socket of this invention and when it is desired to unplug the electrical plug 1, the enlarged heads 413 of the abutting members 41' 41 of the left and right releasing units 4', 4 are pressed simultaneously. Thereafter, the electrical plug 1 may be pulled from the electrical socket.

The main dielectric casing 2 further includes a pair of flanges 253, each of which extends from a periphery of the releasing hole 250 in a respective one of left and right lateral walls 25 of the main dielectric casing 2 and surrounds the first arm 411 of the abutting member 41', 41 of a respective one of the left and right second releasing units 4', 4.

Each of the left and right releasing units 4', 4 further includes left and right flexible members 42' 42, each of which encloses the enlarged head 413 of the abutting member 41', 41 thereof and is mounted on a respective one of the flanges 253 of the main dielectric casing 2.

The electrical socket further includes an inner jacket 61 that encloses fittingly the main dielectric casing 2 and the auxiliary dielectric casing 5. In this embodiment, the inner jacket 61 is formed with three front holes 613, each of which is registered with a respective one of the left and right terminal holes 261 in the front wall 26 of the main dielectric casing and the front opening 51 in the third casing part. The inner jacket 61 is further formed with a left hole (not shown) through which the left flexible member 42' extends, and a right hole 615 through which the right flexible member 42 extends.

The electrical socket further includes an outer jacket 62 that encloses fittingly the inner jacket 61. In this embodiment, the outer jacket 62 is formed with a front opening 621 that exposes the three front holes 613 in the inner jacket 61, a left opening 623 through which the left flexible member 42' extends, and a right opening 622 through which the right flexible member 42 extends.

In this embodiment, the inner and outer jackets are formed by injection molding.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electrical socket, comprising:

a main dielectric casing including a front wall formed with a pair of terminal holes adapted for extension of first and second prongs of an electrical plug;

first and second terminal units, each of which is adapted to be connected to a respective one of the first and second prongs of the electrical plug and each of which extends into said main dielectric casing, said second terminal unit including resilient first and second clamping arms adapted for insertion of the second prong of the electrical plug therebetween; and a latching mechanism including an engaging projection disposed between said first and second clamping arms, provided on said second clamping arm, and adapted to engage a prong hole in the second prong of the electrical plug, and a releasing unit mounted movably on said main dielectric casing, and operable so as to move said second clamping arm away from said first clamping arm against biasing action of said second clamping arm, thereby disengaging said engaging projection from the prong hole in the second prong of the electrical plug.

2. The electrical socket as claimed in claim 1, wherein said main dielectric casing further includes a lateral wall formed with a releasing hole therethrough, said second terminal unit being disposed proximate to said lateral wall of said main dielectric casing, said first and second clamping arms being respectively disposed proximate to and distal from said lateral wall of said main dielectric casing, said releasing unit including an abutting member that extends movably into said main dielectric casing through said releasing hole in said lateral wall of said main dielectric casing, and that abuts against said second clamping arm.

3. The electrical socket as claimed in claim 2, wherein said abutting member includes an arm that extends movably through said releasing hole in said lateral wall of said main dielectric casing, and an enlarged head that is disposed externally of said main dielectric casing, that is connected to said arm thereof, and that has a size larger than that of said releasing hole in said lateral wall of said main dielectric casing.

4. The electrical socket as claimed in claim 3, wherein said main dielectric casing further includes a flange that extends from a periphery of said releasing hole in said lateral wall of said main dielectric casing and that surrounds said arm of said abutting member, said releasing unit further including a flexible member that encloses said enlarged head of said abutting member and that is mounted on said flange of said main dielectric casing.

5. The electrical socket as claimed in claim 3, wherein said first clamping arm has a front end portion, said second terminal unit further including a guiding arm that is coupled to said front end portion of said first clamping arm, said guiding arm and said front end portion of said first clamping arm diverging from each other in a direction toward said front wall of said main dielectric casing.

6. The electrical socket as claimed in claim 1, wherein said main dielectric casing further includes a bottom wall, said electrical socket further comprising an auxiliary dielectric casing that is tubular, that has opposite front and rear openings, and that is coupled to said bottom wall of said main dielectric casing, and a third terminal unit that is adapted to be connected to a third prong of the electrical plug and that extends into said auxiliary dielectric casing through said rear opening.

7. The electrical socket as claimed in claim 6, wherein said bottom wall of said main dielectric casing is formed with an engaging hole therethrough, said auxiliary dielectric casing is provided with an engaging protrusion that engages said engaging hole in said bottom wall of the main dielectric casing, thereby coupling said auxiliary dielectric casing to said main dielectric casing.

8. The electrical socket as claimed in claim 6, further comprising an inner jacket that encloses fittingly said main and auxiliary dielectric casings, and is formed with three through-holes, each of which aligns with a respective one of said terminal holes in said front wall of said main dielectric casing and said front opening in said auxiliary dielectric casing.

9. The electrical socket as claimed in claim 8, further comprising an outer jacket that encloses fittingly said inner jacket, and is formed with a front opening for exposing said through-holes in said inner jacket.

10. The electrical socket as claimed in claim 1, wherein said engaging projection of said second terminal unit extends inclinedly from said second clamping arm away from said front wall of said main dielectric casing.

* * * * *